United States Patent [19]

McMahon et al.

[11] Patent Number: 4,640,165

[45] Date of Patent: Feb. 3, 1987

[54] ROTARY KNIFE SYSTEM

[75] Inventors: Raymond D. McMahon, Naperville; John C. Jellovitz, Lake Barrington; James T. Vaile, Brookfield; Gregory J. Renn, Naperville; Elmer J. Ondeck, Riverside, all of Ill.

[73] Assignee: Baldwin Technology Corporation, Stamford, Conn.

[21] Appl. No.: 722,729

[22] Filed: Apr. 11, 1985

[51] Int. Cl.[4] ..... B26D 1/42

[52] U.S. Cl. ..... 83/346; 83/348; 83/663; 83/699

[58] Field of Search ..... 83/348, 346, 347, 663, 83/673, 674, 698–700, 665

[56] References Cited

U.S. PATENT DOCUMENTS

| | | | |
|---|---|---|---|
| 461,600 | 10/1891 | West | 83/348 |
| 1,577,620 | 3/1926 | Gammeter | 83/346 X |
| 3,555,948 | 1/1971 | Olson | 83/346 X |
| 3,771,399 | 11/1973 | Aterianus | 83/348 |
| 4,249,441 | 2/1981 | Sturtz | 83/348 X |
| 4,406,196 | 9/1983 | Roncato et al. | 83/347 X |

*Primary Examiner*—James M. Meister

*Attorney, Agent, or Firm*—Neuman, Williams, Anderson & Olson

[57] ABSTRACT

A knife holder mounted upon the periphery of the knife roller in an apparatus for cutting lengths of webs such as paper is disclosed. The knife holder in the system disclosed is formed of an elastomeric material. The knife blades are held in place principally by friction in slots cut in the holder and seat themselves in the elastomer during set-up and cutting. Rapid and simple changes of knife blades without torquing or rolling in are achieved by fixing the elastomeric knife holder between readily located clamping members affixed to the surface of the knife roller, and alternative clamping members are provided for retrofit installations.

14 Claims, 8 Drawing Figures

FIG. 1
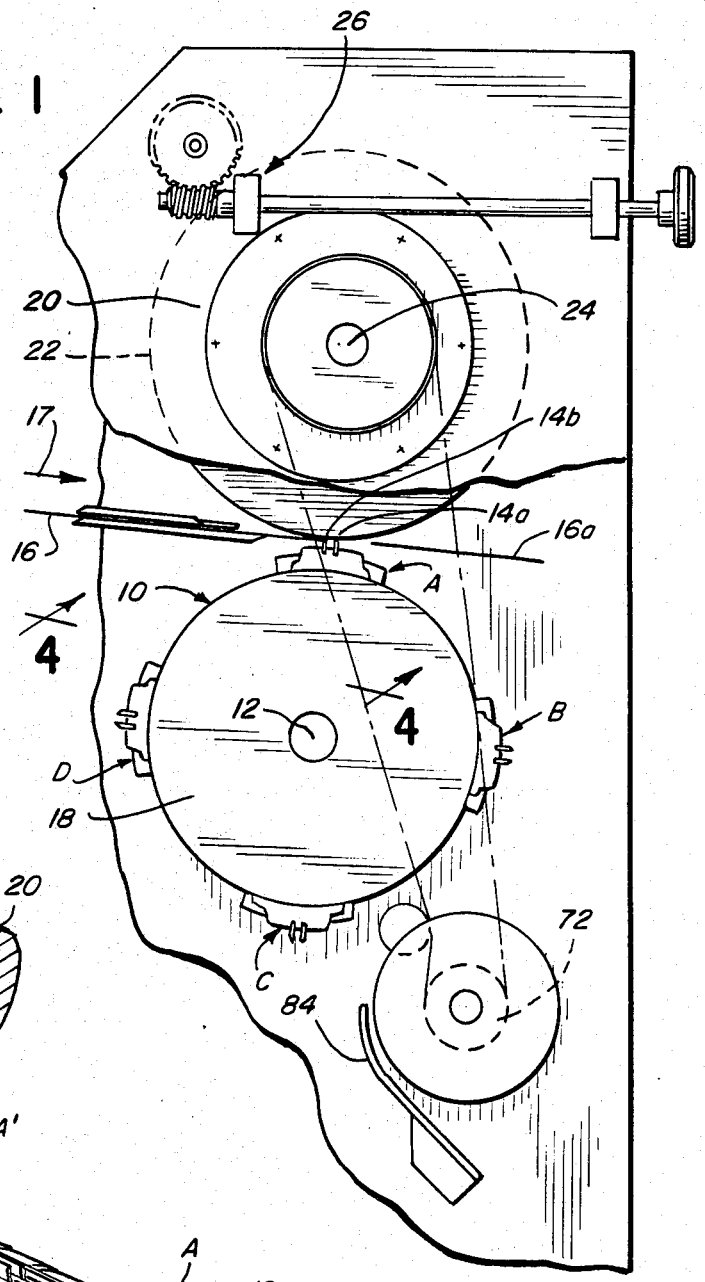
FIG. 8
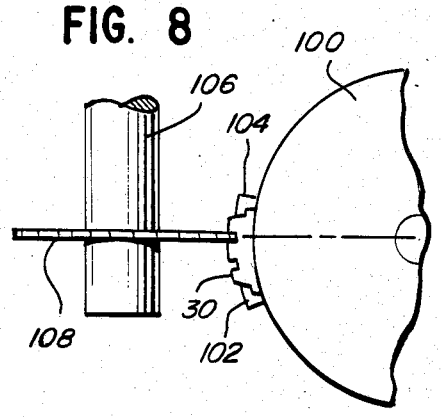
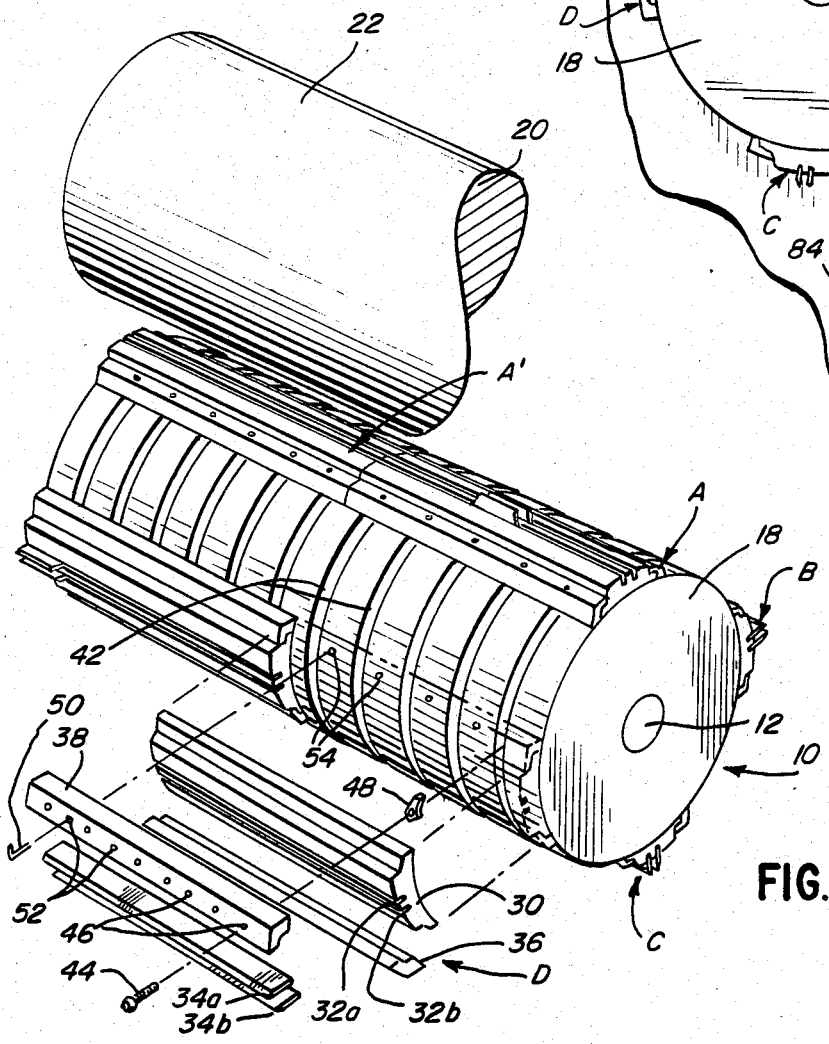
FIG. 2

FIG. 3
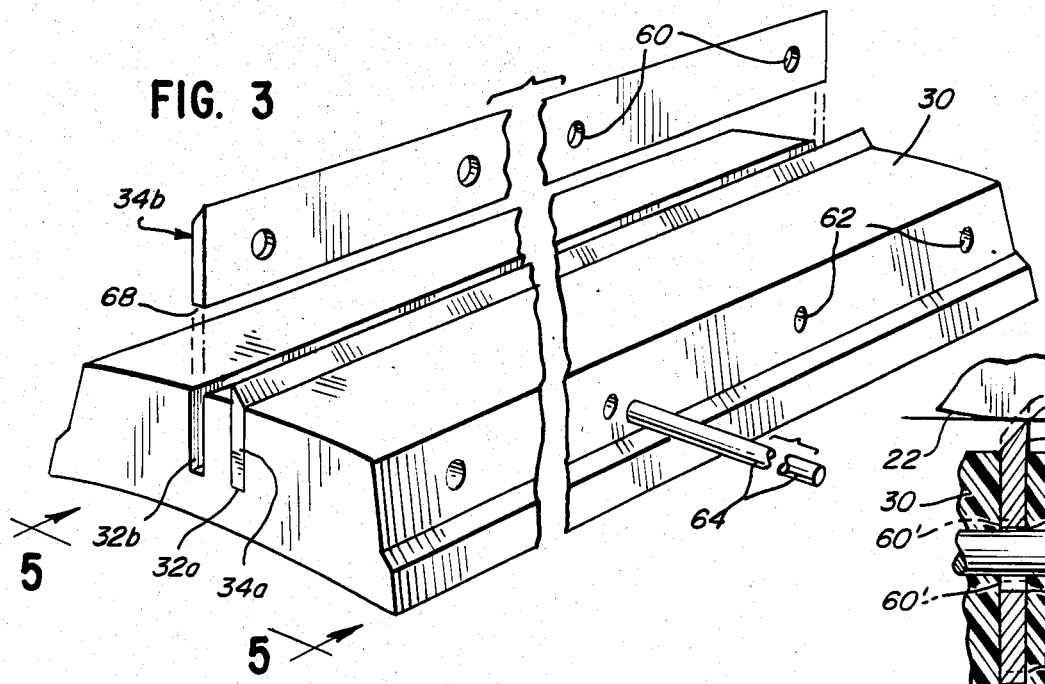
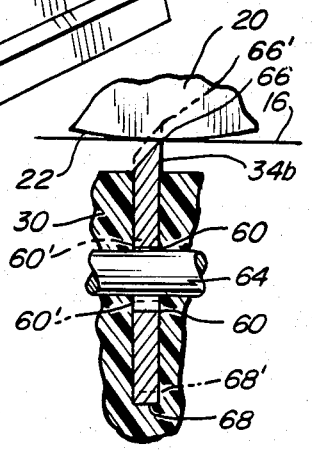
FIG. 5
FIG. 4
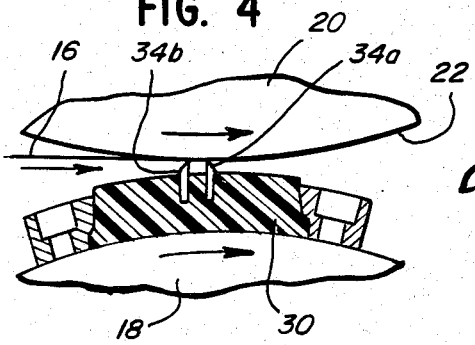
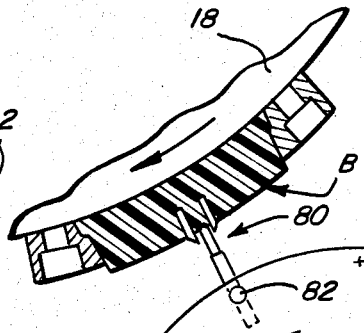
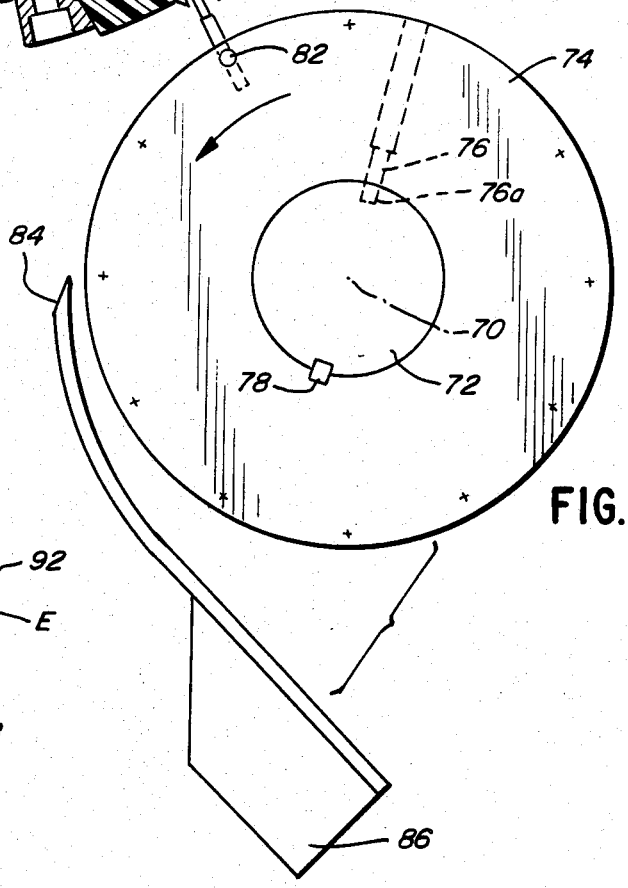
FIG. 6
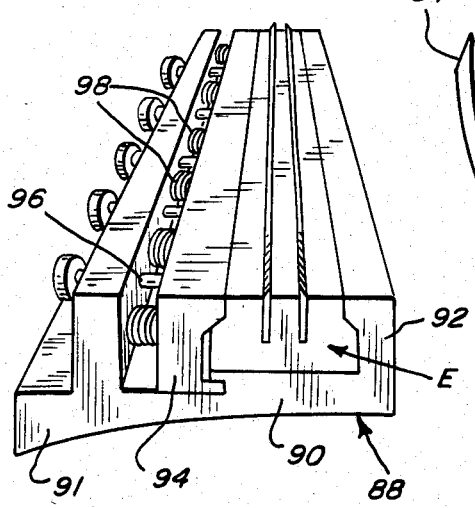
FIG. 7

ROTARY KNIFE SYSTEM

This invention relates to an improved apparatus, for cutting a web of paper or other material such as foil, thin plastic, or webs of combined layers of these or similar materials. More particularly, this invention relates to a knife holder mounted on a roller for cutting a traveling web into a number of pieces. In its preferred embodiment this invention relates to cutting a web of paper.

Papercutting machines are widely used in such industries as the printing industry, and rotary papercutting machines are popular for cutting strips or webs of paper to a desired size. In general, rotary papercutting machines have two cooperating rollers, one of which carries a knife, and the other acts as an anvil against which the knife bears as the paper is cut. The cutting edge of the knife and the surface of the anvil normally rotate at the same speed, and the paper is cut as the cutting edge of the knife moves into and out of engagement with the anvil surface. It is desired that the paper be cut as cleanly, accurately and rapidly as possible, and to this objective a number of prior art patents are directed. Reference may be had to U.S. Pat. Nos. 2,660,242; 2,682,306; 3,709,077; 3,857,314; and 3,893,359 for representative rotary-type papercutting machines. In these and similar machines, there is a need to replace the knife frequently because of the high amount of knife wear from striking or wiping the cutting edge against the metal anvil surface. As a result, a substantial amount of time is spent replacing worn knives.

In the conventional rotary papercutting machine, knife replacement is a time-consuming operation. In typical machines, such as that described in U.S. Pat. No. 3,857,314, the knife is mounted in a rigid base member which is in turn mounted on a rotatable roller. The knife is attached to the base member by a plurality of bolts which hold the knife in a precise position for proper engagement with the anvil surface. In installing a fresh knife, it is necessary to first mount the knife onto the base member and then lightly tighten the bolts to provide a coarse adjustment of the position of the knife on the base member. The anvil and knife rollers are then rotated until the knife pushes against the anvil, causing the knife to seat itself in the proper cutting position. Each of the bolts holding the knife to the base member is then tightened to a specified torque to secure the knife in its final cutting position. This process is referred to as the "rolling-in" or torque-fitting procedure.

Attempts have been made to reduce the amount of setup or make-ready time associated with knife replacement in rotary cutting machines. For example, U.S. Pat. No. 4,412,467 describes a die cutter mounted on a base member which is in turn mounted on the knife roller. A sheet of elastomeric material is interposed between the die and the base to take up the radial forces imposed upon the die during the cutting operation. However, the solution offered by this patent suffers from several disadvantages. First, the dies are difficult to manufacture, making their replacement when the cutting edges become worn almost prohibitively expensive. Secondly, the thickness of the elastomeric sheet placed between the cutting die and the base member must be determined by a trial and error process until the proper positioning of the cutting edge for engagement with the anvil surface is achieved. Thirdly, the die cutter mechanism does not permit the interchangeability of knife blades alone; the entire die must be replaced when the cutting edges are worn.

The present invention is directed to overcoming these and other difficulties inherent in the prior art. In the present invention a knife unit is provided which includes cutting knives mounted within a knife holder formed of an elastomeric material. During the setup of the knife roller and later during the cutting operation, the knife holder yields within its elastic limits to take up displacement of the cutting knifes caused by radial and circumferential forces imposed upon them by the anvil surface.

OBJECTS OF THE INVENTION

An object of this invention is to provide an easily changed knife holding mechanism for holding and mounting the cutting knives on the periphery of the knife roller in a papercutting apparatus.

It is another object of this invention to provide a knife holding mechanism on the knife roller in a papercutting apparatus which does not require precise, lengthy, time-consuming torquing of bolts to hold the cutting knives in place on the roller.

It is a further object of this invention to provide a base member for a knife which holds and supports the knife in the flexible material of the base member.

It is a further object of this invention to provide an elastomeric knife holder in which knives are self-seating, thereby eliminating the "rolling-in" procedure associated with conventional rotary cutters.

Another object of this invention is to provide a knife holder into which cutting knives of varying lengths can be mounted to correspond to the web-width requirements of particular cutting jobs.

Still another object of this invention is to provide a retrofit mechanism for the knife roller in a papercutting apparatus whereby a knife-carrying elastomeric holder can be mounted on a conventional knife roller.

SUMMARY OF THE INVENTION

The above and other objects are accomplished in accordance with this invention by providing a knife holder which can be mounted on the periphery of a knife roller. The body of the holder is made of an elastomeric material, and the cutting knives are carried within slots formed in the resilient elastomer. The elastomer allows the knife holder to yield during set-up and also during the cutting operation to take up displacement of the cutting knives caused by the imposition of force by the anvil surface.

In the preferred embodiment of the invention, the knife holder is molded from a urethane polymer having a Shore D hardness of about 70–80. The cross-sectional thickness of the cutting knife carried within the slot in the knife holder is broad enough so that the radially inward or bottom edge of the cutting knife does not itself cut into the knife holder. The radially inward or bottom surface of the cutting knife is preferably convex so that force is distributed evenly at the interface with the elastomeric material.

While it is not intended that the present invention should be limited to any theory, it is believed that the radial force imposed on the cutting knife by the anvil is transmitted through the knife material to the bottom surface of the knife. It is believed that the bottom surface of the knife then transmits that force to the elastomeric material forming the knife holder and that the elastomeric material then yields within its elastic limits to absorb the force placed upon it by the knife. Similarly, the imposition of circumferential force by the anvil upon the cutting knife will be absorbed by the elastomeric material of the knife holder interacting with the sides of the knife. It is further believed that the direct interaction of the cutting knife with the elastomeric material enhances cutting performance because the elastomeric material of the holder can yield in varying degrees depending upon the particular forces placed upon the cutting edge of the knife during the cutting operation.

In one embodiment of the invention there is a rotary papercutting apparatus comprising a knife roller assembly and a cooperating anvil roller assembly having an anvil on its periphery against which the paper is cut. The knife and anvil roller assemblies rotate about parallel axes in timed relationship to the travel of the paper between them. The knife roller assembly comprises a knife roller, at least one knife holder of a resilient elastomeric material mounted on the periphery of the knife roller and having at least one longitudinally extending slot, and a cutting knife carried within the slot of the knife holder. The knife holder of resilient elastomeric material yields within its elastic limits during the cutting operation to take up displacement of the knife by engagement of the knife with the anvil.

DESCRIPTION OF THE DRAWINGS

FIG. 1 is an end view, partly in section, of a portion of a rotary papercutting apparatus showing the relationship of cooperative knife, anvil, and scrap stripper rollers in accordance with one embodiment of the present invention;

FIG. 2 is an exploded perspective view showing a portion of the knife roller assembly and a cooperating anvil roller of FIG. 1;

FIG. 3 is an exploded and enlarged perspective view of the knife holder shown in FIG. 2 comprising an elastomeric knife holder body, cutting knives, and retaining pin;

FIG. 4 is an enlarged end view of a portion of FIG. 1 taken in the direction of the arrows 4—4 in FIG. 1 showing in cross-section the mounting of the knife-carrying holder on the knife roller and also showing a portion of the cooperating anvil roller;

FIG. 5 is an enlarged transverse sectional view of a portion of FIG. 3 taken in the direction of arrows 5—5 in FIG. 3 and also showing a portion of an anvil roller adjacent the beveled edge of the cutting knife;

FIG. 6 is an enlarged end view of the scrap stripping roller and stripping apparatus shown in FIG. 1;

FIG. 7 is a perspective view of a retrofit clamp assembly for mounting the knife-carrying holder shown in FIG. 3 onto a conventional knife roller (not shown) having a smooth outer surface section; and FIG. 8 is an end view of an apparatus for performing a method for cutting knife-carrying slots in the elastoin FIG. 1. Also, in most conventional systems, the knife and anvil cylinders are vertically positioned relative to each other, i.e., the longitudinal axes of the knife and anvil cylinders are positioned in the same normal vertical plane. However, in the configuration of the present system the cylinders are not in the same normal plane but, rather, are offset from each other. This offset allows for better product control as the web is cut and delivered from the cylinders. The preferred degree of offset is that the knife roller be in the range of 5° to 15° to the side of the anvil roller.

A roller 72 is shown in FIG. 1 for stripping the scrap from the knfie roller 10. The roller 72 is mounted a short distance away from the point at which any scrap which might result from cutting a paper web would become briefly attached to or stuck upon the knife roller assembly 10.

On the knife roller 18 in the knife roller assembly 10 a plurality of knife holder assemblies may be mounted, such as the four assemblies shown as A, B, C and D in FIG. 1. As shown, the four holder assemblies are located 90° apart from each other, although it may be desirable according to the lengths of web to be cut to utilize only one or more up to a total of normally no more than eight. The assemblies A, B, C and D are mounted lengthwise of the knife roller 18, as more particularly shown in FIG. 2, and parallel to the longitudinal axis 12 of the knife roller. The assemblies A, B, C and D may be of convenient lengths so as to accommodate various web widths passing the knife roller. The knife holder assembly A shown in FIG. 2 may be on the order of twenty inches long, and a similar assembly A' may be disposed in end-to-end relationship to it on the surface of the knife roller 18 so as to utilize the full length of a knife roller which may be about forty inches long.

The knife roller assembly 10 and the anvil roller 20 are arranged so that when a web of paper 16 is passed in the direction of arrow 17 between them, the web may be severed at the desired places by action of the knife holder assemblies A, B, C and D, shortly to be described, against the anvil roller 20. All of the knife holder assemblies A, B, C and D are identical. As shown in FIG. 1, a pair of knife blades extends from knife holder assembly A so as to intersect the paper web 16 while it lies against anvil roller 20, and there cut the web into desired lengths **16*a* as shown. The severed sheets 16*a*** are received by conventional means (not shown) for delivery to further processing stations.

The particular description of knife holder assembly D, which follows concerns the form of knife holder which is equipped with two blades. It will be recognized in view of this description that other forms of holders may be designed on the same concepts, so as, for example, to provide holders which are equipped with just a single blade. In such cases, a knife roller assembly such as 10 may be provided with two forms of 34*b* in FIG. 3). Such configuration avoids as much as possible any cutting into an elastomeric knife holder in which the blades are mounted when pressure is exerted on the sharpened edges of the blades. Knife holder 30, which is formed to receive knife blades 34*a* and 34*b*, includes a pair of slots 32*a* and 32*b* extending longitudinally of the holder 30.

The knife blades 34*a* and 34*b* are seated in the slots 32*a* and 32*b*, respectively. The width of each of the slots 32*a* and 32*b* is only slightly less than the cross-sectional thickness of the blades, thus permitting the blades to be held in the slots principally by frictional engagement. Preferably, the knife blades are formed as 34*b*, which has a cross-sectional thickness of about 0.083 to 0.085 inch, and the slots, when formed with a desirable width of approximately 0.081 to 0.083 inch, will properly receive the blades.

Knives 34*a* and 34*b* are further retained in the knife holder 30 by a plurality of retaining pins, one of which is shown in FIG. 3 as retaining pin 64. Knife blade 34*b* has a plurality of spaced holes 60, each hole having a diameter substantially greater than that of the retaining pins (such as pin 64). Similarly, the knife holder 30 also is provided with a plurality of spaced holes 62, but the diameters thereof are only slightly greater than the retaining pins. As previously noted, the blades are oriented along the length of knife holder 30 and are positioned in the slots 32*a* and 32*b*. When the blades are fully seated, the spaced holes 60 in the blades register with the spaced holes 62 in the holder 30, and the pins such as retaining pin 64 are inserted through the knife holder 30 and through the blades 34*a* and 34*b* through holes 62 and 60. Because the holes 62 are constructed with diameters very close to the diameters of the pins 64, the pins are held in place by frictional engagement.

Assembly of the knife holder D on the knife roller 18 of knife roller assembly 10 is shown in FIG. 2. Knife roller 18 is provided with a plurality of dovetail slots 42 extending substantially around the circumference of knife roller 18. Slots 42 are substantially parallel and have sloped side walls configured such that the distance between the side walls forming each slot increases as the depth of the slot increases. The depth of slots 42 in the preferred embodiment shown is about 0.75 inches.

A first retaining member 38 having a plurality of spaced holes 52 is disposed longitudinally along the periphery of knife roller 18. First retaining member 38 is positioned longitudinally along the periphery of knife roller 18 using spaced positioning holes 54 in knife roller 18. Positioning holes 54 are disposed in parallel rows around the circumference of knife roller 18. Each row of positioning holes 54 corresponds to a designated number of knife holders to be mounted on knife roller 18. For example, if 6 knife holders are to be mounted on knife roller 18, then the rows of positioning holes 54 designated as being 60° apart are selected. A plurality of guide pins, one of which is shown in FIG. 2 as guide pin 50, project through spaced guide holes 52 in first retaining members 38 and into positioning holes 54 in knife roller 18. Guide pins 50 are initially retained in guide holes 52 and positioning holes 54 by a slight frictional engagement. However, pins 50 are desirably formed in an L shape so that after the retaining member 38 is fastened in place, as will shortly be described, the pins 50 may be readily grasped by the foot of the L lying outside of retaining member 38 and the body portions of the pins 50 removed from the guide holes 52 and the positioning holes 54.

A first group of fasteners or bolts, one of which is shown in FIG. 2 as bolt 44, is fitted into holes 46 in first retaining member 38, and the fasteners are threaded into a first group of dovetail nuts, one of which is dovetail nut 48, carried within dovetail slot 42. Dovetail nut 48 has its edges formed so as to mate with the walls of slots 42, so that tightening bolt 44 engages the edges of dovetail nut 48 against the walls of slot 42 to retain dovetail nut 48 within slot 42.

A second retaining member 36 is also positioned and secured to the periphery of knife roller 18 in the foregoing manner. Knife holder 30 is interposed between first and second retaining members 38 and 36 on the periphery of knife roller 18 and securely positioned on said periphery by those members.

Anvil roller 20 against which the knives operate from knife roller 18 has a smooth anvil surface 22. The radius of anvil roller 20 is slightly smaller than the distance from knife roller assembly axis 12 to the cutting edges of knives 14*a* and 14*b*. Such difference in diameters provides a difference in surface speeds on the anvil and knife rollers so that cutting may be accomplished in part by a wiping motion of the blade edges on the anvil roller, and thus crushing and tearing the web fibers. In order to bring the knife cutting edges into cutting engagement on the anvil roller, an eccentric bearing mechanism 26 is attached to anvil roller 20. Eccentric bearing mechanisms are well known in the art, and reference may be had to U.S. Pat. Nos. 2,711,935; 3,359,843; and 4,171,655 for representative eccentric bearing mechanisms. Use of eccentric bearing mechanism 26 in conjunction with anvil roller 20 allows minute adjustments to be made in the distance between anvil roller 20 and the cutting edges of the blade in knife roller assembly 10.

Returning now to the assembly of the knife blades in the knife holder, the purpose of providing the knife blades 34*a* and 34*b* with holes 60 having diameters substantially greater than the diameters of the retaining pins such as 64 is illustrated, partly in phantom, in FIG. 5. The cutting edge of knife blade 34*b*, prior to engaging any portion of the web 16, extends outwardly from knife holder 30 in the position shown in phantom at 66'. Also, phantom hole 60' and phantom knife bottom surface 68' illustrate the positions of knife hole 60 and knife bottom surface 68, respectively, prior to engagement with the web. However, when the knife cutting edge 66 engages web 16 against an anvil roller cutting surface, such as anvil surface 22, the displacement of the entire knife blade 34*b*, including hole 60 therein, may move clear to the position shown by solid lines in FIG. 5. The bottom surface 68 settles into the elastomeric material of knife holder 30, and thus knife 34*b* seats itself properly for engagement with anvil surface 22.

Due to the fact that the diameter of retaining pin 64 is smaller than the diameter of hole 60 in the knife, retaining pin 64 does not impede the movement of knife 34*b* into knife holder 30. Yet, in the event of substantial displacement of knife 34*b* within slot 32*b*, such as from excessive centrifugal force created by the knife roller 18, retaining pin 64 will prevent knife 34*b* from either flying out of slot 32*b* or embedding itself too deeply within the elastomeric material of knife holder 30.

The cutting knives carried within the elastomeric knife holder can be either single-beveled as shown, or they may be double-beveled, but using the single-beveled knife 34*b* shown in FIG. 3 in the present invention provides certain advantageous results. It may be necessary at times to change only slightly the length of the web portions being cut. Such changes are normally resisted in view of the substantial change-over time involved, bearing in mind the routine above-described for torquing the blade bolts. However, using the present invention, knife 34*b* can be turned end-for-end and placed back in slot 32*b*, thereby moving the line of impact of the cutting edge a distance corresponding to the thickness of the knife, all without any tedious or expensive delay.

It will also be appreciated that in utilizing the present invention a knife length less than the length of slot 32*b* can be carried within the knife holder 30. Thus, users of the present invention can mount knives of varying lengths in the knife holder according to the requirements of particular job runs without being compelled to use too long a knife. For example, a 10-inch long knife can be mounted within a 20-inch long knife holder when the web to be cut is less than 10 inches in width.

Knife holders incorporating elastomeric bases as described above are adaptable for use in older installations of papercutting apparatus wherein the knife rollers have relatively smooth circumferential surfaces, rather than the channeled surface as shown on knife roller 18 in FIG. 2. As shown by FIG. 7, base member 90 of retrofit clamp assembly 88 has an integral first retaining member 92 which extends longitudinally, that is, parallel to the knife roller axis. A group of fasteners (not shown) projects through base member 90 and is threaded into the knife roller. Those fasteners may be located either underneath the knife-carrying holder E shown in FIG. 7 or disposed through the lip 91 of base member 90, for example, to secure base member 90 to the roller. Second retaining member 94 extends substantially parallel to member 92. Knife-carrying holder assembly E is interposed between members 92 and 94, and is rigidly secured on base member 90 through the application of force against second retaining member 94 by a plurality of springs 98. Guide pins 96 project from base member 90 through second retaining member 94, and retain member 94 on base 90. Alternatively, springs 98 may be replaced by clamps as an alternative manner of securement.

Whether the knife roller is a retrofitted installation or a newly formed roller as shown in FIG. 2, the operation of the cutting knives is identical when the papercutting apparatus is run. Dealing with the form of the invention which was described first above, in operation the cutting knives 34*a* and 34*b*, as they are carried along within knife holder 30, strike or wipe against anvil surface 22 to cut the paper web 16. Especially as shown in FIG. 4, the knife roller 18 rotates in a clockwise direction, while the anvil roller surface 22 rotates in a counterclockwise direction. The paper web 16 enters the cutting area between the rollers where it is engaged first by knife blade 34*a* and then by knife blade 34*b*. At that instant, the elastomeric knife holder 30 absorbs a substantial portion of the radial force generated by an impact with the anvil roller, and also absorbs any impact force which is directed circumferentially. The radial impact movement is particularly shown in FIG. 5.

Preferably the knives 34*a* and 34*b* cut web 16 by wiping it with their cutting edges against the anvil surface 22, the speed of the rollers 18 and 20 being synchronized to achieve cutting in this manner. Also, as above-noted, the radius of the anvil roller 20 is slightly less than the radius of the knife roller measured to the tips of the knife blades 34*a* and 34*b*. This slight difference in the radii of the anvil and knife rollers has been found to improve the cleanliness and accuracy of the cut, and has been found to prolong knife life. It is believed that the slight difference in radii, as noted above, causes the wiping action in the cutting process and achieves a frictional force on the web traveling between the cutting edge of a knife and the anvil surface. These forces are in addition to the crushing of the paper fibers which results from striking the cutting edges of the knives against the anvil surface.

When a pair of knife blades is held in a knife holder, as shown in the construction set forth in FIG. 3, it often occurs that the strip of scrap which is severed from the web 16 between cutting edges of knives 34*a* and 34*b* must be positively removed from between those edges. Accordingly, the scrap removal assembly shown in FIGS. 1 and 6 is provided to strip away such scrap.

Referring first to FIG. 1, the scrap stripper roller 72 is disposed adjacent to the portion of the path followed by the knife cartridge assemblies as they are moved away from the point of cutting web 16. The longitudinal axis 70 of the stripper roller 72 is parallel to the axis 12 of the knife roller 18. Thus, soon after the scrap strip of web 16 is severed, it is carried approximately 120° to a point where it can be removed from between knife blades 34*a* and 34*b* by the scrap stripper roller 72 and its related assembly. That assembly is shown in an enlarged manner in FIG. 6. A plurality of scrap removal discs 74 are mounted on scrap removal roller 72. The discs are spaced apart from each other along the roller and are held in position relative to each other by a series of inserts such as insert 76 engaged in the surface of the stripper roller 72 by threaded fasteners, one of which is shown at 76*a*. Each scrap removal disc 74 supports a scrap removal pin 80 held onto the removal disc by suitable fastening means such as bolt 82. Alternatively, a Vlier pin may be used instead of the bolt 82 which is shown. A longitudinal row of the scrap removal pins 80 is normally formed upon the several removal discs, extending outwardly from the periphery of the discs in a plane containing a radius (extended) from the axis 70 of the roller 72. Thus the outer extremities of the pins 80 will be aligned to positively engage a strip of scrap by impaling it at several points between the knife blades in a knife cartridge. The relationship of one of the pins 80 to the point of engagement of a strip of scrap between the knife blades of knife cartridge assembly B is particularly illustrated in FIG. 6.

Adjacent to the scrap stripper roller 70 and the plurality of discs 74 mounted upon it, a stationary row of arcuately shaped stripping fingers is disposed so that the fingers will engage strips of severed scrap beneath the strips and intermediate the pins 80. One such stripping finger 84 is shown in FIG. 6. The finger 84 is mounted on a bracket 86, the position of which may be adjusted in order to provide precision positioning of the finger. It will readily be noted that the finger forms a ramp which gradually increases in distance away from the scrap removal disc 74 and its associated pin 80. In operation, the scrap removal roller 72 rotates in a timed relationship to the rotation of the knife roller 18 to bring the scrap removal pins such as 80 into an impaling engagement with the strip of scrap between the knife blades of the knife cartridge assembly. Thereafter, the strip of scrap being impaled, it is lifted from between the knives and carried along an arcuate path by the roller 72 until it is engaged by the row of fingers 84. The scrap strip is then lifted from pin 80 as pin 80 passes between the fingers 84, and once lifted from pin 80 it is suitably disposed of in a conventional manner outside the immediate area of operation of the equipment.

While a variety of ways may be used to form the slots 32*a* and 32*b* for holding the knife blades in the body of the knife cartridge 30, it has been found to be advantageous to use the method and equipment illustrated in FIG. 8. A rotary saw blade 108 is mounted on rotating mandrel 106. Rotary saw blade 108 is coplaner with a radius of roller 100. Elastomeric knife holder 30 is rigidly secured on the periphery of roller 100 by retaining members 102 and 104. Slots are cut into knife holder 30 by passing rotary saw blade 108 through the surface of knife holder 30 at a depth corresponding to the width of the knife to be carried within the knife holder 30.

While particular embodiments and applications of the present invention have been shown, it will be understood, of course, that the invention is not limited thereto since modifications may be made by those skilled in the art, particularly in light of the foregoing teachings. It is, therefore, contemplated by the appended claims to cover any such modifications as incorporate those features which come within the true spirit and scope of the invention.

What is claimed is:

1. A rotary-type papercutting apparatus comprising:

(a) a knife roller;

(b) a cooperating anvil roller having an anvil on its periphery against which the paper is cut, said knife roller and said anvil roller being rotatable about parallel longitudinal axes in timed relationship to the travel of the paper therebetween;

(c) at least one knife carrying unit mounted on the periphery of said knife roller, said knife carrying unit movable around the circumference of said knife roller, said knife carrying unit comprising:

(i) a knife holder formed of a resilient elastomeric material having a Shore D hardness of about 70–80 and having at least one slot extending longitudinally on the radially outwardly presented face of said knife holder;

(ii) a cutting knife carried within said slot of said knife holder and having at least one radially outwardly presented cutting edge for engagement with said anvil to cut the paper repeatedly;

(d) means for retaining said knife holder on the periphery of said knife roller comprising at least one retaining member and fastening means passing through said retaining member and into receptacles within said knife roller;

said knife holder formed of resilient elastomeric material yielding within its elastic limits during the cutting operation to take up displacement of said cutting knife by said anvil roller and to allow said cutting knife to settle into its cutting position within said knife holder.

2. The apparatus of claim 1 wherein said knife holder comprises a urethane polymer.

3. The apparatus of claim 1 wherein said cutting edge is single-beveled in cross-section.

4. The apparatus of claim 1 wherein said cutting edge is double-beveled in cross-section.

5. The apparatus of claim 1 further comprising eccentric bearing means for manually adjusting the relative radial displacement between said cutting knife and said anvil.

6. The apparatus of claim 5 wherein said eccentric bearing means is mounted at one end of the longitudinal axis of said anvil roller assembly.

7. The apparatus of claim 1 wherein the diameter of said knife roller assembly is less than the diameter of said anvil roller assembly to create a wiping action of said cutting edge against said anvil.

8. A rotary-type papercutting apparatus comprising:

(a) a knife roller assembly;

(b) a cooperating anvil roller assembly having an anvil on its periphery against which the paper is cut, said two assemblies being rotatable about parallel longitudinal axes in timed relationship to the travel of the paper therebetween; said knife roller assembly comprising:

(c) a knife roller;

(d) at least one knife holder of a resilient elastomeric material mounted on the periphery of said knife roller and having at least one slot extending longitudinally on the radially outwardly presented face of said knife holder;

(e) a cutting knife carried within said slot of said knife holder and having at least one radially presented cutting edge for engagement with said anvil to cut the paper repeatedly and wherein the radially inwardly presented bottom surface of said cutting knife is convex;

said knife holder of resilient elastomeric material yielding within its elastic limits during the cutting operation to take up relative displacement between said cutting knife and said anvil.

9. In a rotary-type papercutting apparatus having a knife roller and a cooperating anvil roller against which the paper is cut, the improvement which comprises at least one knife carrying unit mounted on the periphery of said knife roller, said knife carrying unit movable around the circumference of said knife roller, said knife carrying unit comprising:

(i) a knife holder formed of a resilient elastomeric material having a Shore D hardness of about 70–80 and having at least one slot extending longitudinally on the radially outward face of said knife holder;

(ii) a cutting knife carried within said slot of said knife holder and having at least one radially outward presented cutting edge for engagement with said anvil roller to cut the paper repeatedly;

(iii) means for retaining said knife holder on the periphery of said knife roller comprising at least one retaining member and fastening means passing through said retaining member and into receptacles within said knife roller;

said knife holder formed of resilient elastomeric material yielding within its elastic limits during the cutting operation to take up displacement of said cutting knife by said anvil roller and to allow said cutting knife to settle into its cutting position within said knife holder.

10. The improvement in accordance with claim 9 wherein said cutting knife has a plurality of spaced holes in the face of said cutting knife and further comprising a plurality of retaining pins projecting through said knife holder and further projecting through said holes in said cutting knife to retain said cutting knife within said slot in said knife holder, said retaining pins having a diameter smaller than the diameter of said holes so that said retaining pins do not generally interfere with the radial movement of said cutting knife into said knife holder.

11. In a rotary-type papercutting apparatus having a knife roller assembly and a cooperating anvil roller assembly against which the paper is cut, the improvement which comprises a knife roller assembly comprising:

(a) a knife roller;

(b) at least one knife holder of resilient elastomeric material having at least one slot extending longitudinally on the radially outward face of said knife holder;

(c) means for mounting said knife holder on the periphery of said knife roller, said mounting means comprising:

(i) a plurality of spaced dovetail slots on the periphery of said knife roller and extending substantially around the circumference of said knife roller;

(ii) a first retaining member extending longitudinally on the periphery of said knife roller;

(iii) a first group of fasteners projecting through said first retaining member and threaded into a first group of dovetail nuts carried within said dovetail slots;

(iv) a second retaining member extending longitudinally on the periphery of said knife roller;

(v) a second group of fasteners projecting through said second retaining member and threaded into a second group of dovetail nuts carried within said dovetail slots;

(vi) said knife holder interposed between said first and second retaining members whereby said knife holder is rigidly secured to the periphery of said knife roller;

(d) a cutting knife carried within said slot of said knife holder and having at least one radially outward presented cutting edge for engagement with said anvil to cut the paper repeatedly;

said knife holder of resilient material yielding within its elastic limits during the cutting operation to take up relative displacement between said cutting knife and said anvil.

12. In a rotary-type papercutting apparatus having a knife roller assembly and a cooperating anvil roller assembly against which the paper is cut, the improvement which comprises a knife roller assembly comprising:

(a) a knife roller;

(b) at least one knife holder of resilient elastomeric material having at least one slot extending longitudinally on the radially outward face of said knife holder;

(c) means for mounting said knife holder on the periphery of said knife roller, said mounting means comprising a retrofit clamp assembly carried on a conventional knife roller, said retrofit clamp assembly comprising:

(i) a base member having an integral longitudinally extending first retaining member;

(ii) a group of fasteners projecting through said base member and threaded into said knife roller for securing said base member to said knife roller;

(iii) a longitudinally extending second retaining member substantially parallel to said first retaining member;

(iv) means for applying force against said second retaining member in the direction of said first retaining member whereby said knife holder interposed between said first and second retaining members is rigidly secured on the periphery of said knife roller;

(d) a cutting knife carried within said slot of said knife holder and having at least one radially outward presented cutting edge for engagement with said anvil to cut the paper repeatedly;

said knife holder of resilient material yielding within its elastic limits during the cutting operation to take up relative displacement between said cutting knife and said anvil.

13. The improvement in accordance with claim 12 wherein said force applying means is a spring interposed between said base member and said second retaining member.

14. In a rotary-type papercutting apparatus having a knife roller and a cooperating anvil roller against which the paper is cut, the improvement comprising at least one knife carrying unit mountable on the periphery of said knife roller, said knife carrying unit moveable around the circumference of said knife roller, said knife carrying unit comprising:

(i) a knife holder formed of resilient elastomeric material having a Shore D hardness of about 70–80 and having at least one slot extending longitudinally on the radially outward face of said knife holder;

(ii) a cutting knife carried within said slot and having at least one radially outwardly present cutting edge for engagement with the anvil roller;

said knife holder yielding within its elastic limits during the cutting operation to take up displacment of said cutting knife by the anvil roller and to allow said cutting knife to settle into its cutting position within said knife holder.

* * * * *